US009731331B2

(12) United States Patent
Bauerochse et al.

(10) Patent No.: US 9,731,331 B2
(45) **Date of Patent: *Aug. 15, 2017**

(54) PROCESS FOR THE DEMULSIFYING CLEANING OF METALLIC SURFACES

(71) Applicant: Chemetall GmbH, Frankfurt am Main (DE)

(72) Inventors: Stella Bauerochse, Pforzheim (DE); Carola Komp, Morfelden-Walldorf (DE); Ralph Van Den Berg, Achim (DE); Peter Claude, Bad Vilbel (DE); Franz Dressler, Wiesbaden (DE); Joachim Geldner, Friedrichsdorf (DE); Zafer Yuksel, Konigsbach-Stein (DE); Eckart Schonfelder, Idstein (DE)

(73) Assignee: CHEMETALL GMBH (DE)

( * ) Notice: Subject to any disclaimer, the term of this patent is extended or adjusted under 35 U.S.C. 154(b) by 303 days.

This patent is subject to a terminal disclaimer.

(21) Appl. No.: 14/322,046

(22) Filed: Jul. 2, 2014

(65) Prior Publication Data

US 2014/0311533 A1 Oct. 23, 2014

Related U.S. Application Data

(63) Continuation of application No. 14/055,348, filed on Oct. 16, 2013, now abandoned, which is a continuation of application No. 13/546,317, filed on Jul. 11, 2012, now Pat. No. 8,609,195, which is a continuation of application No. 12/294,111, filed as application No. PCT/EP2007/052867 on Mar. 26, 2007, now abandoned.

(30) Foreign Application Priority Data

Apr. 18, 2006 (DE) ..... 10 2006 018 216

(51) Int. Cl.

| | |
|---|---|
| ***B08B 3/08*** | (2006.01) |
| ***C11D 1/835*** | (2006.01) |
| ***C23G 5/06*** | (2006.01) |
| ***C23G 1/14*** | (2006.01) |
| ***C23G 1/18*** | (2006.01) |
| ***C23G 1/19*** | (2006.01) |
| ***C11D 11/00*** | (2006.01) |
| ***C23C 22/78*** | (2006.01) |
| *C11D 1/72* | (2006.01) |

(52) U.S. Cl.

CPC ..... *B08B 3/08* (2013.01); *C11D 1/835* (2013.01); *C11D 11/0029* (2013.01); *C23C 22/78* (2013.01); *C23G 1/14* (2013.01); *C23G 1/18* (2013.01); *C23G 1/19* (2013.01); *C23G 5/06* (2013.01); *C11D 1/72* (2013.01)

(58) Field of Classification Search

CPC .. C11D 1/62; C11D 1/86; C11D 1/835; C11D 1/72; C11D 1/08; C23G 1/00; C23G 1/14; C23G 1/18; C23G 1/19; C23G 22/78; B08B 3/08

USPC ..... 510/108, 174, 504

See application file for complete search history.

(56) References Cited

U.S. PATENT DOCUMENTS

| | | | | |
|---|---|---|---|---|
| 4,443,363 | A * | 4/1984 | Klinger | C11D 1/721 134/42 |
| 4,548,729 | A | 10/1985 | Schmid et al. | |
| 4,609,488 | A | 9/1986 | Geke et al. | |
| 4,784,798 | A | 11/1988 | Geke et al. | |
| 4,814,108 | A | 3/1989 | Geke et al. | |
| 5,286,402 | A | 2/1994 | Geke et al. | |
| 5,308,401 | A | 5/1994 | Geke et al. | |
| 5,380,468 | A | 1/1995 | Gober et al. | |
| 5,472,512 | A | 12/1995 | Gober et al. | |
| 5,614,027 | A | 3/1997 | Dunn et al. | |
| 5,650,385 | A | 7/1997 | Dunn et al. | |
| 5,712,236 | A | 1/1998 | Bolkan et al. | |
| 5,736,495 | A | 4/1998 | Bolkan et al. | |
| 5,863,881 | A | 1/1999 | Vlasblom | |
| 5,935,920 | A | 8/1999 | Geke et al. | |
| H001818 | H | 11/1999 | Polgeiter et al. | |
| 5,998,352 | A | 12/1999 | Vlasblom | |
| 6,066,606 | A | 5/2000 | Lu et al. | |
| 6,124,253 | A | 9/2000 | Vinci et al. | |
| 6,211,132 | B1 | 4/2001 | Pierce et al. | |
| 6,251,847 | B1 | 6/2001 | Pierce et al. | |
| 6,310,263 | B1 | 10/2001 | Vlasblom | |
| 7,169,192 | B2 | 1/2007 | Fine et al. | |
| 2005/0079992 | A1 | 4/2005 | Smith | |
| 2007/0270323 | A1 | 11/2007 | Stedry et al. | |
| 2010/0068392 | A1 | 3/2010 | Bauerochse et al. | |

FOREIGN PATENT DOCUMENTS

| | | |
|---|---|---|
| DE | 25 56 527 A1 | 6/1977 |
| DE | 32 47 431 A1 | 6/1984 |
| DE | 33 15 951 A1 | 11/1984 |

(Continued)

OTHER PUBLICATIONS

Brunn, et al. "Metal Clreaning and Degreasing", (1997) SurTec GmbH, pp. 1-29. [with English translation].

Geke, Juergen "Use of Neutral Cleaners in the Automotive Industry", Metalloberflaeche, 41 (1987) 5, pp. 227-232.

Lissant, Kenneth J. "Demulsification Industrial Applications", Surfactant Science Series 13, (1983), Marcel Dekker, New York, p. 88.

P3 tensopon 0682, Instructions for Use, Henkel Technologies (2004).

P3-tensopon, General Data (2007).

Stache, H. "Fundamentals of Emulsification Effect of Tensides", Carl Hanser Verlag,2 Ausgabe, Muenchen Wien (1981), p. 205.

*Primary Examiner* — Saeed T Chaudhry

(57) ABSTRACT

The demulsifying cleaning of metallic surfaces which may be contaminated with oil(s) with at least one further non-polar organic compound, with fat(s), with soap(s), with particulate dirt or with at least one anionic organic compound using an aqueous, alkaline, surfactant-containing bath solutions.

13 Claims, No Drawings

(56) References Cited

FOREIGN PATENT DOCUMENTS

| | | | |
|---|---|---|---|
| DE | 40 01 595 | A1 | 7/1991 |
| DE | 40 14 859 | A1 | 11/1991 |
| EP | 0 213 554 | A2 | 3/1987 |
| EP | 0 249 164 | A1 | 12/1987 |
| WO | 92/16607 | A1 | 10/1992 |
| WO | 98/24869 | A1 | 6/1998 |
| WO | 98/26034 | A1 | 6/1998 |
| WO | 2006/058570 | A1 | 6/2006 |

* cited by examiner

PROCESS FOR THE DEMULSIFYING CLEANING OF METALLIC SURFACES

This application is a continuation of U.S. patent application Ser. No. 14/055,348 filed Oct. 16, 2013, incorporated herein by reference in its entirety, which is a continuation of U.S. patent application Ser. No. 13/546,317 filed Jul. 11, 2012, now patented, U.S. Pat. No. 8,609,195, issued Dec. 17, 2013, incorporated herein by reference in its entirety, which is a continuation of U.S. patent application Ser. No. 12/294,111 filed Mar. 5, 2009, incorporated herein by reference in its entirety, now abandoned, which is a §371 of PCT/EP2007/052867 filed Mar. 26, 2007 and claims priority from DE 10 2006 018 216.2 filed Apr. 18, 2006.

The present invention relates to a process for the demulsifying cleaning of metallic surfaces that may possibly be contaminated with non-polar organic contaminants such as for example oil(s) and/or other largely or wholly organic contaminants such as for example fat(s), soap(s) and/or further metal processing aid(s) such as for example drawing aids, including anionic organic compounds and particulate dirt, with an aqueous, alkaline, surfactant-containing bath solution (=cleaning bath, bath), wherein during the cleaning of the metallic surfaces the bath becomes contaminated with oil(s) and/or non-polar organic contaminants.

The cleaning process can in this connection serve in particular as a preliminary stage either before the pretreatment of metallic surfaces of substrates before painting, before the treatment or passivation of metallic surfaces such as for example strips or parts or before the cleaning in an industrial wash unit, or as an intermediate cleaning stage for example before the manufacture of gears or engines.

Often the cleaning baths for cleaning metallic objects, which are intended to remove the contaminants originating in particular from the metal processing and from the corrosion protection from the metallic surfaces of metallic objects, are initially operated in a demulsifying state. However, also after a certain time the demulsifying state of the bath changes to an emulsifying state, and often as a result the cleaning performance constantly deteriorates. Depending on the throughput and degree of contamination and also in the case of a high transfer (drag-in) of oil and other contaminants, such a situation can occur after a period ranging from about one day up to about eight weeks. The question then arises as to how to restore the cleaning bath to a state of high cleaning performance and what effort and cost should be expended in the bath care and maintenance. Bath care and maintenance covers in this connection: 1. possible analysis of the bath composition, pH value and/or alkalinity, 2. possible replenishment of the bath, in particular with surfactant(s) and/or builder(s), 3. removal of oil and other contaminants such as for example particulate dirt from the above, and 4. possible replenishment of water. However, despite the addition of relatively large amounts of demulsifying surfactants often the demulsifying state of the bath can no longer be restored.

In such cases in particular an increased content of emulsifiers, corrosion inhibitors such as for example petroleum sulfonate and/or drawing aids, appears to have a contaminating and interfering effect in the bath. The high contents of anionic organic compounds in a highly contaminated cleaning bath, in particular high contents of anionically acting surfactants, prevent, because of their same-sign negative charges which are present on the surfaces of the oil droplets, the mutual attraction of the oil droplets distributed in the bath. These high contents thus prevent the coalescence of the oil droplets into larger oil droplets and thereby also prevent the demulsifying action with the formation of larger droplets and the separation of oil, which could then possibly even accumulate on the surface of the bath, from where it could be easily removed.

Simple alternatives to the solution, reduction or avoidance of this problem are cleaning processes with a constant overflow, in which corresponding amounts of bath solution are continuously discarded, of cleaning processes which involve operation for a relatively long time up to an increased or high level of contamination and in which the whole bath solution is then replaced by new bath solution in the context of the cleaning and bath care and maintenance. Both alternatives are however expensive.

The highly contaminated cleaning baths often have an oil content in the range from 1 up to 6 or even up to 30 g/l (per litre of bath solution) including other contaminants, a content of fats, soaps and other anionic organic compounds in the range from 0.3 to 3.5 g/l, and a content of surfactants often of the order of magnitude of about 1 g/l.

Such highly contaminated cleaning baths often contain high contents of oils and other contaminants including various types of surfactants: with a total content of organic substances in the bath of for example ca. 10 g/l, this can include ca. 6 g/l of oils, ca. 3 g/l of fats and soaps and also ca. 0.5 to 2 g/l of surfactants, of which however often only about 30 to 70 wt. % are nonionic surfactants, which are necessary for the cleaning, and often even about 0.3 g/l are emulsifiers from the contamination, in which connection the fats, soaps and emulsifiers contain ca. 1.5 to 3 g/l of so-called anionic organic compounds that are in some cases added for example to the corrosion inhibitors and lubricants and also hydrolyse from fats by reaction in an alkaline medium and form anionic organic compounds. In particular, anionic organic compounds such as inter alia anionically acting surfactants often occur in contaminants. In addition a cleaner (detergent) framework with ca. 3 to 50 g/l of builder(s) is often contained.

In the automobile industry membrane filtration units, which are often also expensive and difficult to clean, are in this connection frequently used to remove oil and other contaminants from the cleaning zone located upstream of a phosphating zone in a pretreatment unit, in order to allow a cleansing of the cleaning bath that is as continuous as possible and ensure a cleaning performance that is as consistently high as possible.

In the cleaning of in particular metallic surfaces, such as for example car body parts or body part units before the phosphating and before the subsequent painting operation, attempts have been made for many years, despite the contamination by oil and further non-polar organic contaminants, to establish a bath that is stable for a relatively long time. All or many of these contaminants originate from agents used for temporary corrosion protection, from the processing and/or from the treatment of the metallic surfaces. On account of the often constant transfer of oil and other non-polar organic contaminants to the cleaning bath, a bath care and maintenance operation is necessary from time to time or constantly in order to remove the oils and the other non-polar organic contaminants and to maintain or restore a high cleaning performance.

As bath care and maintenance processes, nowadays the following are industrially used as part of the cleaning processes:

1. Discontinuous bath care and maintenance processes without particularly high investment for the bath care and maintenance, especially in the case of smaller units;

2. Continuous bath care and maintenance processes with an oil separator, for example with a settling vessel, deoiler, coalescence separator, separator, a centrifuge or similar equipment for the oil separation (in particular membrane-free processes using gravity and density differences as the separating principle) for the separation and removal of oils and other non-polar organic contaminants from the cleaning bath and its circulation, the contaminants of the cleaning bath constantly accumulating in the oil separator, from where they can be removed as necessary;
3. Continuous bath care and maintenance processes using a costly membrane filtration process that is complicated to maintain, with a membrane filtration unit (e.g. ultrafiltration or microfiltration unit). The membranes of these units allow the organic constituents, some of the surfactants and water to pass through and largely retain the non-polar organic constituents.

In a discontinuous process without bath care and maintenance measures for improving and/or maintaining the bath, in many cases a unit is in each case started up in a clean state and used until there is an increased or high contamination with oils and other non-polar organic contaminants. In this case the cleaning performance of the cleaning bath constantly drops. Finally the contaminated bath is then as a rule discarded.

A new approach to the type and operation of the bath was therefore required in order to be able to reuse the bath with a high cleaning performance.

In a continuous bath care and maintenance process in many cases a bath is started up in a clean state and then used once for as long as possible, wherein the contamination with oils and other non-polar organic contaminants is continuously or repeatedly removed at short intervals to a certain degree and wherein the substances required for the cleaning are replenished continuously or repeatedly at short intervals, in order to operate the cleaning bath with as high a cleaning performance as possible and under conditions that are as uniform as possible. In this connection the surfaces of membranes used in membrane filtration processes can however easily become coated with fat, grease, particulate dirt and other contaminants and the pore channels of the membranes can become blocked, so that they then have to be cleaned for example by flushing or rinsing. Each membrane filtration process is extremely labour-intensive and cost-intensive.

The cleaning bath is in particular used as a preliminary stage before the pretreatment of surfaces of substrates before painting or before the treatment or passivation of the metallic surfaces or before using an industrial wash unit or for intermediate cleaning. Typically a cleaning bath contains apart from water at least one surfactant and optionally also at least one substance (builder) of the cleaner framework, such as for example in each case at least one borate, carbonate, hydroxide, phosphate, silicate, optionally at least one organic solvent and/or optionally at least one additive such as for example at least one antifoaming agent, as well as optionally at least one entrained oil and optionally further contaminants.

As surfactant(s), typically at least one non-ionic surfactant is added to the aqueous cleaning bath. On account of the contamination of the metallic surfaces, anionic organic compounds, oils and/or often other non-polar organic contaminants, in particular fats and/or soaps, are however often entrained. For this reason, preferably no anionic and/or amphoteric surfactants are added to the cleaning bath since a demulsifying cleaning cannot be achieved with these surfactants.

In addition the cleaning bath can contain, apart from water, in particular builders of the cleaner framework, pickling inhibitors, corrosion inhibitors and optionally further additives. Normally, in the more highly industrialised countries neither the contaminants nor the fresh bath contain significant amounts of organic solvents.

An object of the invention is to provide a process in which a cleaning bath for contaminated metallic surfaces can be cleaned more simply or more cost effectively to remove oil(s), other non-polar organic contaminants such as for example fat(s), particulate dirt, soap(s) and/or other metal processing aids, such as for example drawing aids. A further object is to provide a cleaning process in which the cleaning bath can be operated in a demulsifying manner even if highly contaminated with anionic organic compounds.

This object is achieved by a process for the demulsifying cleaning of metallic surfaces that are possibly contaminated with oil(s), with at least one other non-polar organic compound, with fat(s), with soap(s), with particulate dirt and/or with at least one anionic organic compound, using an aqueous, alkaline, surfactant-containing bath solution (=cleaning bath, bath), wherein on cleaning the metallic surfaces the bath becomes contaminated with oil(s), with at least one other non-polar organic compound, with fat(s), with soap(s), with particulate dirt and/or with at least one anionic organic compound, which process is characterised in that the bath contains at least one demulsifying surfactant and/or this is added to the bath, that the bath also contains at least one cationic organic compound and/or this is added to the bath, and that the bath is maintained in a demulsifying state, even with increasing contamination in particular with at least one anionic organic compound.

The process according to the invention is used in particular a) before the treatment, before the passivation and/or for corrosion protection of the metallic surfaces with an aqueous, surfactant-containing bath, b) before the so-called pretreatment of metallic surfaces of substrates, for example before painting, for example with a pretreatment composition (conversion treatment), such as for example by phosphating, before joining, before shaping/forming and/or before painting, c) before the use of an industrial washing unit and/or d) as intermediate cleaning for example before production of gears or engines.

Hereinafter no distinction is made between bath, bath solution and cleaning bath, and therefore the term "bath" is generally employed. In this connection the term includes for example also a solution that is applied for example by spraying.

The aqueous alkaline surfactant-containing bath that is used for the alkaline cleaning preferably has a pH value in the range from 7 to 14, in particular in the range from pH 8 to 12, and especially in the range from pH 9 to 11.

The oils used in practice are nowadays very complex mixtures, which include a large number of different substances apart from the constituents of the base oil. An oil can therefore in many cases contain some 50 different substances. The term "oil" is understood here in the context of the present application to mean on the one hand an "oil-containing composition", which is a composition based on a large number of compounds with a substantially oil-like character, which contains at least one base oil and typically also at least one anionic organic compound such as for example at least one compound based on petroleum sulfonate. On the other hand the term "oil" denotes in the context of the present application also at least one base oil from this oil-containing composition. In the contamination of the bath in particular the at least one base oil, but also fat(s), soap(s), the at least one (further) anionic organic compound and/or some further substances added to the base oil as well as their reaction products in particular with water interfere, and as a result the cleaning performance of the bath is reduced or is even destroyed. In this connection in particular the at least one anionic organic compound affects the state of the bath.

Often naphthenic and/or aliphatic oils are oils that possibly contribute to the contamination of the bath. These oils are most commonly termed processing oils. However, in certain circumstances they are for example also referred to and/or used as quenching oils, hardening oils, honing oils, corrosion prevention oils, cooling/lubricating emulsions, cooling/lubricating oils, cutting oils and/or forming/shaping oils.

Although the content of oils in the bath operated in accordance with the invention can in principle also assume high values, such as for example 1 g/l, 5 g/l or 10 g/l, in the process according to the invention the content either of oil(s) (in the strict sense) or of oil-containing composition (=oil(s) including other contaminants which can possibly originate in part from the constituents of the oils, but also in part from chemical reactions involving the constituents of the oil-containing composition) in the bath, especially in continuous operation, is preferably maintained at not more than 3 g/l, in particular not more than 2.5, 2, 1.5, 1, 0.8, 0.6, 0.4, 0.2 or 0.1 g/l or preferably in the range from 0.01 to 3 g/l, particularly preferably in the range from 0.02 to 2.2 g/l or from 0.03 to 1.5 g/l, most particularly preferably in the range from 0.05 to 1 g/l. In this connection samples are taken from the middle of the bath, in which only minor or indeed no amounts of oil-containing phase are to be found on the bath surface, in particular in a demulsifying state. In the process according to the invention it is particularly preferred if the content of oil(s), including other contaminants, in the cleaning bath is maintained in the range from 0.03 to 2 g/l or from 0.05 to 1 g/l and the content of surfactants is maintained in the range from 0.05 to 0.7 g/l. However, a base oil need not always occur as contaminant, especially if the contaminants are residues of a deep drawing grease and/or of a soap used for cold forming.

In particular oil(s), fat(s), soap(s), metal processing aids such as for example drawing agents and/or possibly also particulate dirt can occur as non-polar organic contaminants, which like the oil(s) originate in particular from the metal processing and/or from corrosion prevention agents. Particulate dirt can in this connection occur as a mixture based substantially on dust, abraded material for example from metallic material(s), rubber, plastic(s) and/or lubricant(s), metallic chips/shavings, welding smoke and/or welding beads.

The anionic organic compounds belong mainly to the polar organic contaminants and as a rule carry in each case at least one carboxyl group, hydroxycarboxyl group, phosphate group, phosphonate group, sulfonate group and/or sulfate group. These compounds are as a rule readily soluble in an alkaline medium. They are amphiphilic, anionic organic compounds such as for example anionic surfactants, petroleum sulfonate(s), aminocarboxylic acid(s), soap(s) and/or their derivatives. They frequently act as corrosion inhibitors and/or as lubricants. They are often added as additives to the oils. The substances added as additives to the oils, for example as corrosion inhibitors, forming aids, formulation additives, biocides, etc., can in each case independently of one another have a polar or non-polar charge or be uncharged or anionically charged. The majority of these additives however in most cases also belong to anionic organic compounds. The remaining constituents of these additives are however mostly present in relatively minor amounts. Often they do not or do not significantly interfere.

Fats and fatty oils can often hydrolyse in aqueous alkaline media and thereby form soaps, which can also be included among the anionic organic compounds, for example based on caprylic acid, lauric acid, oleic acid, palmitic acid and/or stearic acid, in particular based on alkali caprylates, alkali laurates, alkali oleates, alkali palmitates and/or alkali stearates, such as for example sodium stearate and/or potassium stearate, and in particular corresponding further carboxylates. Compounds hydrolysed in water (soaps), which often exhibit surfactant-like properties and can be polar and/or non-polar (adjacent to one another), can form from fats and fatty oils.

The contamination usually includes at least one oil, and in many cases also at least one anionic organic compound. If oil(s) containing a very large number of additives are used, then in practice the demulsifying operation of the bath is often restricted since the content of anionic organic compounds that is taken up in the cleaning operation in the bath is too high. The initial or previously existing demulsifying performance of the bath decreases with increasing contamination, for example by anionic organic compound(s), and can readily be exhausted if the contents of anionic organic compounds become too large, for the anionic organic compounds can accumulate in the bath and increasingly limit the cleaning performance of the bath. An initially demulsifying surfactant can then lose its demulsifying action in the bath. Under the normal conditions of a cleaning bath a demulsifying surfactant has a demulsifying action, but can lose its demulsifying action especially because of the transfer of anionic organic compounds and/or reactions leading thereto.

In particular the process according to the invention is envisaged for cleaning processes and baths with contaminants that have contents of anionic organic compounds, in particular contents of anionic organic compounds in the range from 0.2 g/l up to very high contents, such as for example of the order of magnitude of about 100 g/l. In many cases the contents are in the range from 0.25 to 60 g/l or in the range from 0.3 to 40 g/l, particularly frequently in the range from 0.35 to 30 g/l or in the range from 0.4 to 20 g/l, and most particularly often in the range from 0.45 to 15 g/l, in the range from 0.5 to 10 g/l or in the range from 0.55 to 5 g/l. Nevertheless the baths can operate simply and with a good demulsifying effect in accordance with the invention if the bath contains the corresponding amounts and/or corresponding additives are added to the bath.

In many cases it is advantageous or even necessary to limit the content of anionic organic compounds in a bath to specific maximum values, since otherwise the demulsification of oil is reduced or prevented, with the result that the content of oil and other contaminants in the bath rises and the cleaning performance of the bath decreases. The content of anionic organic compounds is in many variants of implementation limited to values of as far as possible not more than for example 50 g/l, for example when using a centrifuge unit to spin off the contamination from the surface of the bath. In an industrial unit used for example for highly shaped parts, before the further treatment in particular for corrosion protection of the metallic surfaces, before passivation, before pretreatment for example with a composition for conversion treatment such as for example phosphating, before joining and/or before forming/shaping, it may possibly be recommended to allow as far as possible no more than for example 5 g/l of anionic organic compounds in an aqueous alkaline surfactant-containing bath. In a car body cleaning unit in the automobile industry it may be possibly be necessary to allow not more than for example 1 g/l of anionic organic compounds in the cleaning bath, in order to be able to operate the unit continuously and without special bath care and maintenance measures.

The fact is, the content of anionic organic compounds in a cleaning bath can in many units on account of the likewise contained specific types of oil(s) in the contamination have an effect on the demulsifying action of the bath even in very low amounts: for example, about 0.05 or about 0.1 g/l of anionic organic compounds is already sufficient to reduce or even completely prevent the demulsifying action, which depends inter alia also on the type of substances present.

When cleaning metallic surfaces to remove oil-containing compositions the size of the primarily removed oil droplets is normally very small, i.e. in many cases of a diameter for example in the range from 0.5 to 5 or even up to 50 μm. A large oil-water interface is however in general energetically unfavourable, so that the chemical system has a tendency for a plurality of small oil droplets to merge so as to form at least one larger oil droplet. This procedure is also termed coalescence. It ceases however when the oil droplets reach a radius of curvature that is predetermined by the geometry of the employed surfactant or surfactant mixtures. In this connection it is recommended in many variants of implementation to establish, through the choice of surfactants, their contents and their mixture, a specific radius of curvature of the oil droplets as the predominant possible radius of curvature in baths via the coverage of the oil droplets. In this case the process according to the invention can be optimised in a fine range. This radius of curvature is in many variants of implementation preferably adjusted so that the oil in a moved bath is still not quite emulsified and so that an oil-containing phase has therefore still not accumulated or not yet accumulated markedly on the surface of the bath, but however spontaneously deposits in a quiescent bath, such as for example in a separating vessel (oil separator) and accumulates on the surface of the bath as an oil-containing phase, which often contains contaminants other than oil.

It was now found that the demulsifying state can be maintained by the optionally renewed addition of at least one cationic organic compound, which in particular can also be at least one surfactant and/or at least one cationic polymer, such as for example at least one cationic polyelectrolyte. A demulsifying state is in this connection also understood to denote a state of the bath in which the constituents of the oil-containing composition, i.e. in particular oil(s) and anionic organic compound(s) separate and collect in particular as an oil-containing phase also on the bath surface, from which it can be removed. In this way the bath can be cleaned ("maintained") in a simple way by removing the contaminants from the surface of the bath.

The demulsification is produced by the coalescence of small oil droplets to form larger oil droplets. If the oil droplets are sufficiently large, these can float on the surface of the bath and collect there. This process can be impaired or even suppressed by contents of emulsifiers and/or anionic organic compounds.

The demulsifying state of a bath can be recognised by the fact that with a reduced movement or no movement of the bath an oil-containing phase is spontaneously deposited and possibly accumulates as an oil-containing phase on the surface of the bath and/or, in rare cases, on the floor of the bath container, whereas with a certain movement or powerful movement of the bath no oil-containing phase is deposited. Preferably no emulsifier is added to the bath, or in individual variants of implementation only a small amount of at least one emulsifier is intentionally added in an amount of up to 0.5 g/l, preferably up to 0.2 g/l, particularly preferably up to 0.05 g/l, especially if the bath exhibits little or no movement. At least one emulsifier can depending on the circumstances also be entrained by the contamination. The demulsifying surfactants and the cationic organic compounds act as demulsifiers. The nonionic surfactants used for the cleaning likewise often act in this connection as demulsifiers. They then act in particular as demulsifiers if the arrangement of the surfactant molecules on the oil droplet leads to a curvature that is not too large. The size of the oil droplets then determines the bath state: the smaller the oil droplets the more strongly emulsifying is the bath, and the larger the oil droplets the more strongly demulsifying is the bath.

The process leading to coalescence is reduced or even suppressed by the presence of anionic organic compounds in the bath, since the anionic organic compounds absorbed on the oil droplets produce an identical charge on the oil droplets, which in turn produces a mutual repulsion of the oil droplets. This anionic charge can be partly or even completely neutralised by the addition of for example cationic organic compounds, so that furthermore a demulsifying state exists and the coalescence of the oil droplets can proceed further.

In practice this means for many variants of implementation that the content of anionic organic compounds in the bath solution can be determined for example by Epton titration and that appropriate amounts of at least one cationic organic compound can be added to the bath. The total amounts of cationic organic compounds contained in the bath should therefore preferably be chosen so that the demulsifying state is achieved again and/or continues further to the desired extent. In this connection it may be advantageous in some variants of implementation if a state is established that is just demulsifying but is not yet strongly demulsifying.

Preferably the at least one demulsifying surfactant that is contained in the bath and/or that is added to the bath is chosen from nonionic surfactants and/or from cationic surfactants, in particular from nonionic demulsifying surfactants and/or from cationic demulsifying surfactants. Normally all cationic surfactants can have a demulsifying effect due to the interaction with at least one anionic organic compound. Furthermore many nonionic surfactants have a demulsifying effect in particular on account of their molecular geometry, polarity of the overall molecule and/or the surfactant mixture. The at least one demulsifying surfactant serves in this connection to reduce the surface tension, to clean, to demulsify, to adjust the emulsifying or demulsifying properties, and/or to reduce the foaming tendency. The at least one demulsifying, in particular cationic and/or nonionic surfactant also acts as a demulsifying surfactant as long as the conditions of use are adjusted so that it exists in a demulsifying state that depends substantially on the chemical composition, on the type and amount of the contaminants, on the salt content and on the temperature of the bath as well as on the type and output of the bath circulation and/or pumping.

The contents of demulsifying surfactants in the cleaning bath are preferably in the range from 0.01 to 30 g/l, particularly preferably in the range from 0.05 to 20 g/l, and most particularly preferably in the range from 0.08 to g/l or from 0.1 to 10 g/l. Generally in this case contents of demulsifying surfactants are used in the range from 0.1 to 5 g/l in spraying processes, and in the range from 0.2 to 10 g/l in immersion processes, usually irrespective of whether continuous or discontinuous processes are involved.

In the process according to the invention at least one demulsifying surfactant is preferably chosen from the group of nonionic surfactants and is in particular at least one based on ethoxylated alkyl alcohols, ethoxylated-propoxylated alkyl alcohols, ethoxylated alkyl alcohols with an end group cap and ethoxylated-propoxylated alkyl alcohols with an end group cap, wherein the alkyl group of the alkyl alcohols—saturated or unsaturated, branched or unbranched—can optionally have an average number of carbon atoms in the range from 6 to 22 carbon atoms with in each case either a linear or branched chain construction, wherein the alkyl group can optionally have one or more aromatic and/or phenolic groups, wherein the ethylene oxide chain can optionally have in each case on average 2 to 30 ethylene oxide units, wherein the propylene oxide chain can optionally have in each case on average 1 to 25 propylene oxide units, and wherein optionally an end group cap, in particular with an alkyl group—saturated or unsaturated, branched or unbranched—with on average 1 to 8 carbon atoms, can occur.

In this connection at least one demulsifying surfactant can in particular be selected from the group of nonionic surfactants based on ethoxylated alkylphenols, ethoxylated-propoxylated alkylphenols, ethoxylated alkylphenols with an end group cap and ethoxylated-propoxylated alkylphenols with an end group cap, wherein the alkyl group of the alkylphenols—saturated or unsaturated, branched or unbranched—has an average number of carbon atoms in the range from 4 to 18 carbon atoms, wherein the ethylene oxide unit can optionally have in each case on average 2 to 30 ethylene oxide units, wherein the propylene oxide chain can optionally have in each case on average 1 to 25 propylene oxide units, and wherein optionally an end group closure, in particular with an alkyl group—saturated or unsaturated, branched or unbranched—with on average 1 to 8 carbon atoms, can occur.

In this connection at least one demulsifying surfactant can in particular be selected from the group of nonionic surfactants based on ethoxylated alkylamines and contained in the bath, whose alkyl group—saturated or unsaturated—has an average number of carbon atoms in the range from 6 to 22 with in each case a linear or branched chain construction, and whose polyethylene oxide chain has an average number of ethylene oxide units in the range from 3 to 30 and/or whose average number of propylene oxide units is in the range from 1 to 25.

In this connection at least one demulsifying surfactant can in particular be selected from the group of nonionic surfactants based on ethoxylated or ethoxylated-propoxylated alkanoic acids, whose alkyl group—saturated, unsaturated or cyclic—has an average number of carbon atoms in the range from 6 to 22 with in each case a linear or branched chain construction and whose polyethylene oxide chain has an average number of ethylene oxide units in the range from 2 to 30 and/or whose average number of propylene oxide units is in the range from 1 to 25.

In this connection at least one demulsifying surfactant can in particular be selected from the group of nonionic surfactants based on block copolymers and contained in the bath, which contain at least one polyethylene oxide block and at least one polypropylene oxide block, whose polyethylene oxide block contains on average from 2 to 100 ethylene oxide units and whose polypropylene oxide block contains on average from 2 to 100 propylene oxide units, wherein optionally independently of one another in each case one or more polyethylene oxide blocks and polypropylene oxide blocks can be contained in the molecule.

The contents of demulsifying surfactants and/or of nonionic surfactants are removed proportionately together with the contaminants from the cleaning baths and therefore have to be replenished as appropriate in order to maintain and restore the cleaning performance. These surfactants normally do not participate in any chemical reactions, usually remain in solution and thus usually remain proportionately or largely in the bath, but are removed proportionately together with the contaminants from the bath.

In the discontinuous mode of operation it may be worthwhile, when removing the contaminants, to replace all the bath contents when cleaning the unit (bath replacement).

In the process according to the invention at least one cationic organic compound that is contained in the cleaning bath and/or added to the bath is preferably selected from the group consisting of cationic surfactants and cationic polymers. In this connection the term "cationic polymers", as also at the other places where the further polymeric variants are not listed, denotes a selection from the group consisting of cationic polymers, cationic copolymers, cationic block copolymers and cationic graft copolymers. The cationic organic compounds serve in particular to produce and/or intensify the possibly weakly demulsifying, too weakly demulsifying or even non-demulsifying mode of operation and action of the bath, which contains at least one demulsifying, in particular nonionic surfactant, on account of the demulsifying action of the at least one cationic organic compound, and/or to maintain the demulsifying mode of operation and action of the bath for as long as possible or even indefinitely. Because of the demulsifying mode of operation oil is separated from the bath and the service life of the bath is prolonged.

At least one cationic organic compound is preferably selected a) from amphiphilic compounds that contain at least one quaternary ammonium group and/or at least one ring group with at least one nitrogen atom as head group, wherein either the at least one nitrogen atom of the ring group or the ring group itself has at least one positive charge, and the at least one alkyl group—saturated or unsaturated—has independently of one another in each case an average number of carbon atoms in the range from 4 to 22 carbon atoms with in each case either a linear or branched chain construction, wherein the alkyl group—saturated or unsaturated, branched or unbranched—optionally independently of one another can in each case contain one or more aromatic groups or can be replaced by these, and wherein optionally at least one alkyl group can have a different number of carbon atoms than at least one other alkyl group, and/or is selected from b) cationic polymers, which in the case of water-soluble cationic polymers are often also cationic polyelectrolytes, wherein the cationic polymers contain at least one quaternary ammonium group and/or at least one nitrogen-containing heterocyclic positively charged group with 5 or 6 ring atoms and at least five units of a monomer base building block or a plurality—especially 1, 2, 3, 4 or 5—of different monomer base building blocks in at least one polymer chain. Suitable monomer base building blocks are in this connection cationically charged polymers, in particular cationic polyelectrolytes, in particular those that contain at least one quaternary nitrogen atom, at least one guanidinium group, at least one quaternised imidazoline group (=imidazolium group), at least one quaternised oxazolium group and/or at least one quaternised pyridyl group (=pyridinium group), such as for example those based on ethyleneimine(s), hexamethylenediamineguanidinium compounds, oxazolium, vinylimidazolium, vinylpyridinium compounds, such as for example the corresponding chlorides. In particular 1 to 1,000,000 quaternary ammonium groups and/or 1 to 1,000,000 nitrogen-containing heterocyclic positively charged groups with 5 or 6 ring atoms can be present in a molecule, in each case independently of one another, preferably 5 to 800,000, particularly preferably 15 to 600,000 and most particularly preferably 25 to 400,000 such units. In particular 5 to 1,500,000 units of a monomer base building block or a plurality of different monomer base building blocks can be present in a molecule, in each case independently of one another, preferably 25 to 1,100,000, particularly preferably 75 to 600,000 and most particularly preferably 100 to 200,000 such units. In the case of different types of monomer base building blocks in a molecule these blocks—optionally in specific regions—can be arranged randomly, isotactically, syndiotactically, atactically and/or blockwise, for example as block copolymers or graft copolymers.

In this connection at least one cationic organic compound is preferably selected from amphiphilic compounds of the general Formula (I)

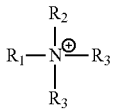

wherein $N^{\oplus}$ denotes nitrogen as a quaternary ammonium compound, wherein $R_1$ is an alkyl group—saturated or unsaturated—with an average number of carbon atoms in the range from 4 to 22 carbon atoms with in each case either a linear or branched chain construction, wherein the alkyl group $R_1$ can optionally contain one or more aromatic and/or phenolic groups or can be replaced by these, wherein $R_2$ denotes hydrogen, $(EO)_x$ (=polyether chain of the formula "—CH—$CH_2$—O—" with x=1 to 50 units with or without an end group cap in particular with a methyl, ethyl, propyl, isopropyl, butyl, isobutyl or benzyl group), $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) or an alkyl group—saturated or unsaturated—with an average number of carbon atoms in the range from 1 to 22 carbon atoms with either a linear or branched chain construction, wherein the alkyl group $R_2$ can optionally contain one or more aromatic and/or phenolic groups or can be replaced by these, wherein $R_3$ independently of one another denotes hydrogen, $(EO)_x$ (=polyether chain of the formula "—$CH_2$—$CH_2$—O—" with x=1 to 50 units with or without an end group cap in particular with a methyl, ethyl, propyl, isopropyl, butyl, isobutyl or benzyl group), $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) and/or an alkyl group—saturated or unsaturated—with an average number of carbon atoms in the range from 1 to 10 carbon atoms with either a linear or branched chain construction, wherein optionally at least one of the alkyl groups $R_3$ independently of one another can contain one or more aromatic and/or phenolic groups or can be replaced by these, wherein optionally $R_2$ and/or at least one group $R_3$ independently of one another can contain and/or form one or more groups selected from amino groups, carbonyl groups, ester groups, ether groups, OH groups and nitro groups on at least one of the carbon atoms and/or between the carbon atoms of at least one alkyl group.

It is particularly preferred with compounds of the general formula (I) to choose for $R_2$ alkyl groups with 1 or with B to 16 carbon atoms; it is most particularly preferred to choose these groups having 1 or 10 to 14 carbon atoms. It is particularly preferred with compounds of the general formula (I) to choose for $R_3$ alkyl groups with 1 or 6 carbon atoms, the latter in particular as a benzyl group.

In this connection at least one cationic organic compound is preferably selected from amphiphilic compounds of the general formula (II)

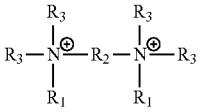

wherein $N^{\oplus}$ denotes nitrogen as a quaternary ammonium compound, wherein $R_1$ independently of one another denotes an alkyl group—saturated or unsaturated—with an average number of carbon atoms in the range from 4 to 22 carbon atoms with in each case either a linear or branched chain construction, wherein optionally at least one of the alkyl groups $R_1$ independently of one another can contain one or more aromatic and/or phenolic groups and/or can be replaced by these, wherein $R_2$ denotes an alkyl group—saturated or unsaturated—with an average number of carbon atoms in the range from 1 to 22 carbon atoms with dither a linear or branched chain construction, wherein the alkyl group $R_2$ can optionally contain one or more aromatic and/or phenolic groups or be replaced by the latter, wherein $R_3$ independently of one another denotes hydrogen $(EO)_x$ (=polyether chain of the formula "—$CH_2$—$CH_2$—O—" with x=1 to 50 units with or without an end group cap in particular with a methyl, ethyl, propyl, isopropyl, butyl, isobutyl or benzyl group), $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) and/or an alkyl group—saturated or unsaturated—with an average number of carbon atoms in the range from 1 to 10 with in each case either a linear or branched chain construction, wherein optionally at least one of the alkyl groups $R_3$ independently of one another can contain one or more aromatic and/or phenolic groups and/or can be replaced by these, wherein optionally $R_2$ independently of one another can contain one or more groups selected from amino groups, carbonyl groups, ester groups, ether groups, OH groups and nitro groups on at least one of the carbon atoms and/or between the carbon atoms of at least one alkyl group, wherein optionally at least one group $R_3$ independently of one another can contain and/or form one or more groups selected from amino groups, carbonyl groups, ester groups, ether groups, OH groups and nitro groups on at least one of the carbon atoms and/or between the carbon atoms of at least one alkyl group.

It is particularly preferred with compounds of the general formula (II) to choose for $R_2$ alkyl groups with 1 or 8 to 16 carbon atoms; it is most particularly preferred to choose these groups with 1 or 10 to 14 carbon atoms. It is particularly preferred with compounds of the general formula (II) to choose for $R_3$ alkyl groups with 1 or 6 carbon atoms, the latter in particular as a benzyl group.

In this connection at least one cationic organic compound is preferably selected from amphiphilic compounds of the general formula (III)

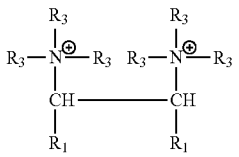

wherein $N^{\oplus}$ denotes nitrogen as a quaternary ammonium compound, wherein optionally CH—CH can be replaced by CH—$R_4$—CH, wherein $R_4$ independently of one another denotes an alkyl group—saturated or unsaturated—with an average number of carbon atoms in the range from 1 to 14 carbon atoms with in each case either a linear or branched chain construction, wherein optionally at least one of the alkyl groups $R_4$ independently of one another can contain one or more aromatic and/or phenolic groups and/or can be replaced by the latter, wherein optionally at least one of the alkyl groups $R_4$ independently of one another can also contain at least one amino group, carbonyl group, ester group, ether group, OH group and nitro group on at least one of the carbon atoms and/or between the carbon atoms of at least one alkyl group, wherein optionally $N^{\oplus}$—CH can be replaced by $N^{\oplus}$—$R_5$—CH, wherein $R_5$ independently of one another denotes an alkyl group—saturated or unsaturated—with an average number of carbon atoms in the range from 1 to 8 carbon atoms with in each case either a linear or branched chain construction, wherein optionally at least one of the alkyl groups $R_5$ independently of one another can contain one or more aromatic and/or phenolic groups and/or can be replaced by the latter, wherein optionally at least one of the alkyl groups $R_5$ independently of one another can also contain at least one amino group, carbonyl group, ester group, ether group, OH group and nitro group on at least one of the carbon atoms and/or between the carbon atoms of at least one alkyl group, wherein $R_1$ independently of one another denotes hydrogen or an alkyl group—saturated or unsaturated—with an average number of carbon atoms in the range from 4 to 22 carbon atoms with in each case either a linear or branched chain construction, wherein optionally at least one of the alkyl groups $R_1$ independently of one another can contain one or more aromatic and/or phenolic groups and/or can be replaced by the latter, wherein $R_3$ independently of one another denotes hydrogen $(EO)_x$ (=polyether chain of the formula "—$CH_2$—$CH_2$—O—" with x=1 to 50 units with or without an end group cap in particular with a methyl, ethyl, propyl, isopropyl, butyl, isobutyl or benzyl group), $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) and/or an alkyl group—saturated or unsaturated—with an average number of carbon atoms in the range from 1 to 10 with in each case either a linear or branched chain construction, wherein optionally at least one of the alkyl groups $R_3$ independently of one another can contain one or more aromatic and/or phenolic groups and/or can be replaced by the latter, wherein optionally at least one of the groups $R_3$ independently of one another can contain and/or form one or more groups selected from amino groups, carbonyl groups, ester groups, ether groups, OH groups and nitro groups on at least one of the carbon atoms and/or between the carbon atoms of at least one alkyl group.

It is particularly preferred with compounds of the general formula (III) to choose for $R_4$ alkyl groups with 1 to 4 carbon atoms; it is most particularly preferred to choose these having 2 or 3 carbon atoms. It is particularly preferred with compounds of the general formula (III) to choose for $R_5$ alkyl groups with 1 to 6 carbon atoms; it is most particularly preferred to choose these with 2 to 5 carbon atoms.

In this connection at least one cationic organic compound is preferably selected from amphiphilic compounds of the general formula (IV) and their tautomers

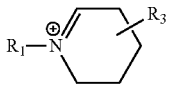

wherein $N^{\oplus}$ denotes nitrogen, wherein one, two, three, four, five, six, seven, eight or nine $R_3$ can be bonded to the ring of the general formula (IV), wherein the $R_1$ bonded to the nitrogen is obligatory and the $R_3$ bonded to the ring is optional, wherein the ring contains one, two or three double bonds, wherein optionally in the ring one or more carbon atoms can be replaced independently of one another by at least one nitrogen atom, at least one sulfur atom and/or by at least one oxygen atom, wherein optionally an $R_3$ can be bonded to this at least one nitrogen atom, wherein optionally also one, two, three or four cyclic groups, which are saturated, unsaturated or aromatic, can independently of one another be fused with 5 or 6 ring atoms on the first ring, wherein optionally independently of one another one, two, three or four $R_3$ can be bonded in this at least one further ring, wherein optionally in this at least one further ring independently of one another one or more carbon atoms can be replaced by at least one nitrogen atom, at least one sulfur atom and/or by at least one oxygen atom, wherein optionally an $R_3$ can be bonded to this at least one nitrogen atom, wherein $R_1$ is an alkyl group—saturated or unsaturated—with an average number of carbon atoms in the range from 4 to 22 carbon atoms with in each case either a linear or branched chain construction, wherein optionally the alkyl group $R_1$ can contain one or more aromatic and/or phenolic groups or can be replaced by the latter, wherein $R_3$ independently of one another denotes hydrogen, an amino group, carbonyl group, ester group, ether group, nitro group, OH group, $(EO)_x$ (=polyether chain of the formula "—$CH_2$—$CH_2$—O—" with x=1 to 50 units with or without an end group cap in particular with a methyl, ethyl, propyl, isopropyl, butyl, isobutyl or benzyl group), $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) and/or an alkyl group—saturated or unsaturated—with an average number of carbon atoms in the range from 1 to 6 carbon atoms with in each case either a linear or branched chain construction, wherein optionally at least one of the alkyl groups $R_3$ can contain independently of one another one or more aromatic and/or phenolic groups or can be replaced by the latter, wherein optionally at least one group $R_3$ can contain independently of one another one or more groups selected from amino groups, carbonyl groups, ester groups, ether groups, OH groups and nitro groups on at least one of the carbon atoms and/or between the carbon atoms of at least one alkyl group.

In this connection at least one cationic organic compound is preferably selected from amphiphilic compounds of the general formula (V) and their tautomers

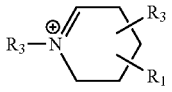

wherein $N^{\oplus}$ denotes nitrogen, wherein optionally one, two, three, four, five, six, seven or eight $R_3$ can be bonded to the ring of the general formula (V), wherein the $R_3$ bonded to the nitrogen and the $R_1$ bonded to the ring are obligatory and wherein the $R_3$ bonded to the ring is optional, wherein the ring comprises one, two or three double bonds, wherein optionally in the ring one or more carbon atoms independently of one another can be replaced by at least one nitrogen atom, at least one sulfur atom and/or by at least one oxygen atom, wherein optionally an $R_3$ can be bonded to this at least one nitrogen atom, wherein optionally also one, two, three or four cyclic groups, which are saturated, unsaturated or aromatic, can also be fused independently of one another with 5 or 6 ring atoms on the first ring, wherein optionally independently of one another one, two, three or four $R_5$ can be bonded in this at least one further ring, wherein optionally in this at least one further ring independently of one another one or more carbon atoms can be replaced by at least one nitrogen atom, at least one sulfur atom and/or by at least one oxygen atom, wherein optionally an $R_3$ can be bonded to this at least one nitrogen atom, wherein $R_1$ denotes an alkyl group—saturated or unsaturated—with an average number of carbon atoms in the range from 4 to 22 carbon atoms with in each case either a linear or branched chain construction, wherein the alkyl group $R_1$ can optionally contain one or more aromatic and/or phenolic groups or can be replaced by the latter, wherein $R_1$ is bonded to a carbon atom without a double bond or to a carbon atom with a double bond, wherein $R_3$ independently of one another denotes hydrogen, an amino group, carbonyl group, ester group, ether group, nitro group, OH group, $(EO)_x$ (=polyether chain of the formula "—$CH_2$—$CH_2$—O—" with x=1 to 50 units with or without an end group cap in particular with a methyl, ethyl, propyl, isopropyl, butyl, isobutyl or benzyl group), $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) and/or an alkyl group—saturated or unsaturated—with an average number of carbon atoms in the range from 1 to 6 carbon atoms with in each case either a linear or branched chain construction, wherein optionally at least one of the alkyl groups $R_3$ independently of one another can contain one or more aromatic and/or phenolic groups or can be replaced by the latter, wherein optionally at least one group $R_3$ independently of one another can contain one or more groups selected from amino groups, carbonyl groups, ester groups, ether groups, OH groups and nitro groups on at least one of the carbon atoms and/or between the carbon atoms of at least one alkyl group.

In this connection at least one cationic organic compound is preferably selected from amphiphilic compounds of the general formula (VI) and their tautomers

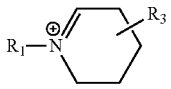

wherein $N^{\oplus}$ denotes nitrogen, wherein one, two, three, four, five, six or seven $R_3$ can be bonded to the ring, wherein the ring contains one or two double bonds, wherein the $R_1$ bonded to the nitrogen is obligatory and the $R_3$ bonded to the ring is optional, wherein optionally in the ring and independently of one another one or more carbon atoms can be replaced by at least one nitrogen atom, at least one sulfur atom and/or by at least one oxygen atom, wherein optionally an $R_3$ can be bonded to this at least one nitrogen atom, wherein optionally also one, two or three cyclic groups, which are saturated, unsaturated or aromatic, can be fused independently of one another with 5 or 6 ring atoms to the first ring, wherein optionally independently of one another one, two, three or four $R_3$ can be bonded in this at least one further ring, wherein optionally in this at least one further ring independently of one another one or more carbon atoms can be replaced by at least one nitrogen atom, at least one sulfur atom and/or by at least one oxygen atom, wherein optionally an $R_3$ can be bonded to this at least one nitrogen atom, wherein $R_1$ is an alkyl group—saturated or unsaturated—with an average number of carbon atoms in the range from 4 to 22 carbon atoms with in each case either a linear or branched chain construction, wherein the alkyl group $R_1$ can optionally contain one or more aromatic and/or phenolic groups or can be replaced by the latter, wherein $R_3$ independently of one another denotes hydrogen, an amino group, carbonyl group, ester group, ether group, nitro group, OH group, $(EO)_x$ (=polyether chain of the formula "—$CH_2$—$CH_3$—O—" with x=1 to 50 units with or without an end group cap in particular with a methyl, ethyl, propyl, isopropyl, butyl, isobutyl or benzyl group), $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) and/or an alkyl group—saturated or unsaturated—with an average number of carbon atoms in the range from 1 to 6 carbon atoms with in each case either a linear or branched chain construction, wherein optionally at least one of the alkyl groups $R_3$ independently of one another can contain one or more aromatic and/or phenolic groups or be replaced by the latter, wherein optionally at least one group $R_3$ independently of one another can contain one or more groups selected from amino groups, carbonyl groups, ester groups, ether groups, OH groups and nitro groups on at least one of the carbon atoms and/or between the carbon atoms of at least one alkyl group.

In this connection at least one cationic organic compound is preferably selected from amphiphilic compounds of the general formula (VII) and their tautomers

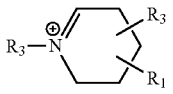

wherein $N^{\oplus}$ denotes nitrogen, wherein one, two, three, four, five or six $R_3$ can be bonded to the ring, wherein the ring contains one or two double bonds, wherein the $R_3$ bonded to the nitrogen and the $R_1$ bonded to the ring are obligatory and wherein the $R_3$ bonded to the ring is optional, wherein optionally in the ring independently of one another one or more carbon atoms can be replaced by at least one nitrogen atom, at least one sulfur atom and/or by at least one oxygen atom, wherein optionally an $R_3$ can be bonded to this at least one nitrogen atom, wherein optionally also one, two or three saturated, unsaturated and/or aromatic cyclic groups can be fused independently of one another with 5 or 6 ring atoms on the first ring, wherein optionally independently of one another one, two, three or four $R_3$ can be bonded in this at least one further ring, wherein optionally in this at least one further ring independently of one another one or more carbon atoms can be replaced by at least one nitrogen atom, at least one sulfur atom and/or by at least one oxygen atom, wherein optionally an $R_3$ can be bonded to this at least one nitrogen atom, wherein $R_1$ is an alkyl group—saturated or unsaturated—with an average number of carbon atoms in the range from 4 to 22 carbon atoms with in each case either a linear or branched chain construction, wherein optionally the alkyl group $R_1$ can contain one or more aromatic and/or phenolic groups or can be replaced by the latter, wherein $R_3$ independently of one another denotes hydrogen, an amino group, carbonyl group, ester group, ether group, nitro group, OH group, $(EO)_x$ (=polyether chain of the formula "—$CH_2$—$CH_2$—O—" with x=1 to 50 units with or without an end group cap in particular with a methyl, ethyl, propyl, isopropyl, butyl, isobutyl or benzyl group), $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) and/or an alkyl group—saturated or unsaturated—with an average number of carbon atoms in the range from 1 to 6 carbon atoms with in each case either a linear or branched chain construction, wherein at least one of the alkyl groups $R_3$ independently of one another can optionally contain one or more aromatic and/or phenolic groups or can be replaced by the latter, wherein optionally at least one group $R_3$ independently of one another can contain one or more groups selected from amino groups, carbonyl groups, ester groups, ether groups, OH groups and nitro groups on at least one of the carbon atoms and/or between the carbon atoms of at least one alkyl group.

Preferably at least one amphiphilic cationic organic compound of the general formulae (I), (II) and (III) contains on the head group or groups with a central nitrogen atom in each case at least one hydroxyl, ethyl, methyl, isopropyl, propyl and/or benzyl group independently of one another as $R_2$ and/or $R_3$, wherein optionally also at least one longer alkyl chain and/or a plurality of alkyl chains can be present. With the cationic organic compounds of the general formulae (I), (II), (III), (IV), (V), (VI) and (VII) as well as their tautomers, $R_1$—independently of one another, saturated or unsaturated, branched or unbranched—optionally comprises one or more aromatic and/or phenolic groups. With the cationic organic compounds of the general formulae (I), (II), (III), (Iv), (V), (VI) and (VII) as well as their tautomers, $R_3$—independently of one another, saturated or unsaturated, branched or unbranched—optionally contains one or more aromatic and/or phenolic groups, wherein at least one of the alkyl groups optionally independently of one another can in each case be at least one methyl group, ethyl group, hydroxyl group, isopropyl group, propyl group and/or benzyl group. Preferably in the cases in which $(PO)_y$ is contained in compounds of the general formulae (I), (II), (III), (IV), (V), (VI) and (VII) as well as their tautomers, $(EO)_x$ is also present, wherein it is optionally also preferred that $(EO)_x$ be contained alone without $(PO)_y$.

It is particularly preferred with compounds of the general formulae (I), (II), (III), (IV), (V), (VI) and (VII) as well as their tautomers to choose for $R_1$ alkyl groups with 8 to 16 carbon atoms; it is most particularly preferred to choose these alkyl groups with 10 to 14 carbon atoms. It is particularly preferred with compounds of the general formulae (I), (II), (III), (IV), (V), (VI) and (VII) as well as their tautomers to choose x from 1 to 7 units; it is most particularly preferred to choose x from 4 or 5 units. It is particularly preferred with compounds of the general formulae (I), (II), (III), (IV), (V), (VI) and (VII) as well as with their tautomers to choose y from 1 to 4 units; it is most particularly preferred to choose y from 2 or 3 units. It is particularly preferred with compounds of the general formulae (I), (II), (II), (III), (IV), (V), (VI) and (VII) as well as with their tautomers to choose for $R_3$ alkyl groups with 1 or 6 carbon atoms, the latter in particular as a benzyl group.

In this connection at least one cationic organic compound is preferably chosen from cationic polymers, cationic copolymers, cationic block copolymers and cationic graft copolymers that contain at least one cationic group of the general formula (VIII):

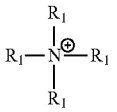

wherein the compound contains 1 to 500,000 cationic groups, which independently of one another have the chemical structures mentioned hereinafter, wherein $N^{\oplus}$ denotes nitrogen as a quaternary ammonium group, wherein at least one quaternary ammonium group contains at least one alkyl group $R_1$, which independently of one another denotes hydrogen, an alkyl group A—saturated or unsaturated, branched or unbranched—with a number from 1 to 200 carbon atoms and/or denotes an oxygen-containing group such as for example an OH group or oxygen as a bridging atom to a next group, such as for example an alkyl group B with a number from 1 to 200 carbon atoms, wherein the majority of the quaternary ammonium groups contain at least two alkyl groups $R_1$, which independently of one another denote hydrogen, an alkyl group A—saturated or unsaturated, branched or unbranched—with a number from 1 to 200 carbon atoms and/or an oxygen-containing group such as for example an OH group or oxygen as a bridging atom to a next group, such as for example an alkyl group B with a number from 1 to 200 carbon atoms, wherein optionally at least one alkyl group A and/or at least one alkyl group B independently of one another can contain one or more aromatic and/or phenolic groups or can be replaced by the latter, wherein optionally at least one alkyl group A and/or at least one alkyl group B independently of one another can be one or more groups selected from hydrogen, an amino group, carbonyl group, ester group, ether group, nitro group, OH group, $(EO)_x$ (=polyether chain of the formula "—$CH_2$—$CH_2$—O—" with x=1 to 50 units with or without an end group cap in particular with a methyl, ethyl, propyl, isopropyl, butyl, isobutyl or benzyl group) and $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) on at least one of the carbon atoms and/or between the carbon atoms of the alkyl group A and/or of the alkyl group B, and can be replaced by the latter, wherein optionally at least one polymer chain independently of one another, branched or unbranched, with a number of polymer units n ranging from 5 to 1,000,000 monomer base building blocks can be bonded to at least one alkyl group $R_1$ independently of one another, wherein the polymer units of at least one cationic group are selected at least in part from polyamides, polycarbonates, polyesters, polyethers, polyamines, polyimines, polyolefins, polysaccharides, polyurethanes, their derivatives, their mixtures and their combinations, wherein optionally at least one uncharged monomer and/or at least one corresponding uncharged group can be present as monomer base building block(s) independently of one another, wherein optionally at least one quaternary ammonium group can be present independently of one another with the nitrogen atom in the polymer chain and/or with the nitrogen atom on the polymer chain.

With the compounds selected from compounds of the general formulae VIII, IX and X and their tautomers, a combination of cationic groups consisting of at least two different cationic groups of different general formulae VIII, IX and X and/or their tautomers can also be present in at least one compound.

With the compounds of the general formulae VIII, IX and X and their tautomers the cationic group that is indicated in these general formulae, and/or their tautomeric cationic group, can in each case independently of one another be present at least once, but in some embodiments at least 2, preferably with 3, 4, 5, 6, 7, 8 to 20, 21 to 30, 31 to 40, 41 to 50, 51 to 60, 61 to 100, 101 to 200, 201 to 500, 501 to 1,000, 1,001 to 2,000, 2,001 to 5,000, 5,001 to 10,000, 10,001 to 50,000, 50,001 to 100,000, 100,001 to 200,000, 200,001 to 500,000 cationic groups can be present. In some variants of implementation a mixture of compounds selected from compounds of the general formulae VIII, IX and X and their tautomers is present, the number of cationic groups being in the range from 30 to 300,000, preferably in the range from 100 to 100,000, sometimes in the range from 100 to 50,000, in the range from 800 to 120,000 or in the range from 2,000 to 250,000. Often a mixture of these compounds with a smaller or larger range of the number of cationic groups and/or with a smaller or larger range of the numbers of polymer units n is present. It is particularly preferred in this connection if such a compound has a number of polymer units n that is larger by a factor of 1 to 1,000 than the number of cationic groups including their optionally contained tautomeric cationic groups, in particular by a factor in the range from 1.5 to 100, most particularly preferably by a factor in the range from 2 to 30, especially by a factor in the range from 3 to 12 or from 3.5 to 8.

With the compounds selected from compounds of the general formulae VIII, IX and X and their tautomers, preferably at least one quaternary ammonium group occurs independently of one another with the nitrogen atom in the polymer chain and/or with the nitrogen atom on the polymer chain, sometimes in a proportion of at least 25% of all such groups that are present or in a proportion of at least 75% of all such groups that are present. Most particularly preferably they occur mainly, almost completely or completely independently of one another with the nitrogen atom in the polymer chain and/or with the nitrogen atom on the polymer chain.

In the compounds selected from compounds of the general formulae VIII, IX and X and their tautomers, the polymer units of at least one cationic group are particularly preferably selected mainly, almost completely or completely from polyamides, polycarbonates, polyesters, polyethers, polyamines, polyimines, polyolefins, polysaccharides, polyurethanes, their derivatives, their mixtures and their combinations. In some variants of implementation such compounds should be chosen in particular so that the polymer units of at least 25% of all cationic groups, of more than 50% of all cationic groups, of at least 75% of all cationic groups, of virtually all cationic groups or of all cationic groups are in each case independently of one another chosen to an extent of at least 25%, largely (≥50%), at least 75%, almost completely or completely from polyamides, polycarbonates, polyesters, polyethers, polyamines, polyimines, polyolefins, polysaccharides, polyurethanes, their derivatives, their mixtures and their combinations.

In the compounds selected from compounds of the general formulae VIII, IX and X and their tautomers, particularly preferably mainly, almost completely or completely independently of one another uncharged monomers and/or corresponding uncharged groups occur as monomer base building block(s).

In the compounds of the general formulae VIII, IX and X and their tautomers, for example at least one compound selected from polyethylenes, polypropylenes, polystyrenes, polyvinyl alcohols, polyvinylamines, polyvinyl esters, such as for example polyvinyl acetates, polyvinyl ethers, polyvinyl ketones and their derivatives, their mixtures and their combinations, can occur as derivatives of the polymer units of the polyolefins.

In the compounds of the general formulae VIII, IX and X and their tautomers, for example at least one compound selected from polyamino Acids, polyaramides and their derivatives, their mixtures and their combinations, in particular selected from diaminocarboxylic acids, diaminodicarboxylic acids and their derivatives, their mixtures and their combinations, can occur as derivatives of the polymer units of the polyamides.

In the compounds of the general formulae VIII, IX and X and their tautomers, for example at least one compound selected from hydroxycarboxylic acids, dihydroxycarboxylic acids, polycarbonates and their derivatives, their mixtures and their combinations, in particular selected from polyester polycarbonates and their derivatives, their mixtures and their combinations, can occur as derivatives of the polymer units of the polyesters.

In the compounds of the general formulae VIII, IX and X and their tautomers, for example at least one compound selected from polyether block amides, polyalkylene glycols, polyamides, polyether ether ketones, polyether imides, polyether sulfones and their derivatives, their mixtures and their combinations can occur as derivatives of the polymer units of the polyethers.

In the compounds of the general formulae VIII, IX and X and their tautomers, for example at least one compound selected from alkylenediamines, polyethyleneimines, vinylamine polymers and their derivatives, their mixtures and their combinations, in particular selected from diethylene diamines, dipropylenediamines, ethylenediamines, propylenediamines, triethylenediamines, tripropylenediamines, polyethylenediamines, polypropylenediamines, vinylamine polymers and their derivatives, their mixtures and their combinations, can occur as derivatives of the polymer units of the polyamines.

In the compounds of the general formulae VIII, IX and X and their tautomers, for example at least one compound of corresponding biological polymers such as those based on cellulose, glycogen, starch and their derivatives, their modifications, their mixtures and their combinations, in particular selected from polyglucosides, condensation products of fructose or glucose and their derivatives, their mixtures and their combinations, can occur as derivatives of the polymer units of the polysaccharides.

In this connection at least one cationic organic compound is preferably chosen from cationic polymers, cationic copolymers, cationic block copolymers and cationic graft copolymers, which contain at least one cationic group of the general formula (IX) and/or their tautomer(s):

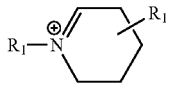

wherein the compound contains 1 to 500,000 cationic groups, which independently of one another have the chemical structures mentioned hereinafter, wherein N⊕ denotes nitrogen, wherein independently of one another zero, one, two, three, four, five, six, seven, eight or nine R1 can be bonded to the ring of the cationic group, wherein the $R_1$ bonded to the nitrogen is obligatory and the $R_1$ bonded to the ring is optional, wherein the ring of the cationic group contains independently of one another one, two or three double bonds, wherein optionally in the ring of the cationic group independently of one another one or more carbon atoms can be replaced by at least one nitrogen atom, at least one sulfur atom and/or by at least one oxygen atom, wherein optionally also one, two, three or four saturated, unsaturated and/or aromatic cyclic groups with 5 or 6 ring atoms can independently of one another be fused on the first ring of the cationic group, wherein optionally independently of one another one, two, three or four R1 can be bonded in this at least one further ring, wherein optionally in this at least one further ring independently of one another one or more carbon atoms can be replaced by at least one nitrogen atom, at least one sulfur atom and/or by at least one oxygen atom, wherein optionally $R_1$ independently of one another can denote an alkyl group A—saturated or unsaturated, branched or unbranched—with a number from 1 to 200 carbon atoms, which can optionally contain one or more aromatic and/or phenolic groups independently of one another or can be replaced by the latter, and/or can denote a group selected from amino groups, carbonyl groups, ester groups, ether groups, OH groups, nitro groups, groups $(EO)_x$ (=polyether chain of the formula "—$CH_2$—$CH_2$—O—" with x=1 to 50 units with or without an end group cap in particular with a methyl, ethyl, propyl, isopropyl, butyl, isobutyl or benzyl group) and/or groups $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group), and/or can denote an oxygen-containing group that contains oxygen as a bridging atom to a next alkyl group B—saturated or unsaturated, branched or unbranched—with a number from 1 to 200 carbon atoms, which optionally can contain one or more aromatic and/or phenolic groups independently of one another or can be replaced by the latter, and/or can optionally contain a group selected from amino groups, carbonyl groups, ester groups, ether groups, OH groups and nitro groups on at least one of the carbon atoms and/or between the carbon atoms in each case of at least one of the alkyl groups A and/or B, and/or wherein optionally independently of one another at least one polymer chain branched or unbranched with a number of polymer units n from 5 to 1,000,000 monomer base building blocks can be bonded to at least one of the groups $R_1$ independently of one another, wherein the polymer units of at least one cationic group are selected at least in part from polyamides, polycarbonates, polyesters, polyethers, polyamines, polyimines, polyolefins, polysaccharides, polyurethanes, their derivatives, their mixtures and their combinations, wherein optionally independently of one another at least one uncharged monomer and/or at least one corresponding uncharged group can occur as monomer base building block(s), wherein optionally at least one quaternary ammonium group can be present independently of one another with the nitrogen atom in the polymer chain and/or with the nitrogen atom on the polymer chain.

In this connection at least one cationic organic compound is preferably selected from cationic polymers, cationic copolymers, cationic block copolymers and cationic graft copolymers, which contain at least one cationic group of the general formula (X) and/or their tautomer(s):

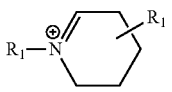

wherein the compound contains 1 to 500,000 cationic groups, which independently of one another have the chemical structures mentioned hereinafter, wherein $N^{\oplus}$ denotes nitrogen, wherein independently of one another zero, one, two, three, four, five, six or seven $R_1$ can be bonded to the ring of the cationic group, wherein the $R_1$ bonded to the nitrogen is obligatory and the $R_1$ bonded to the ring is optional, wherein the ring of the cationic group contains independently of one another one or two double bonds, wherein optionally in the ring of the cationic group independently of one another one or more carbon atoms can be replaced by at least one nitrogen atom, at least one sulfur atom and/or by at least one oxygen atom, wherein optionally also one, two or three saturated, unsaturated and/or aromatic cyclic groups with 5 or 6 ring atoms can be fused independently of one another on the first ring of the cationic group, wherein optionally one, two, three or four $R_1$ can be bonded independently of one another in this at least one further ring, wherein optionally in this at least one further ring independently of one another one or more carbon atoms can be replaced by at least one nitrogen atom, at least one sulfur atom and/or by at least one oxygen atom, wherein optionally $R_1$ independently of one another can denote an alkyl group A—saturated or unsaturated, branched or unbranched—with a number from 1 to 200 carbon atoms, which optionally can contain one or more aromatic and/or phenolic groups independently of one another or can be replaced by the latter, and/or a group selected from amino groups, carbonyl groups, ester groups, ether groups, OH groups, nitro groups, groups $(EO)_x$ (=polyether chain of the formula "—$CH_2$—$CH_2$—O—" with x=1 to 50 units with or without an end group cap in particular with a methyl, ethyl, propyl, isopropyl, butyl, isobutyl or benzyl group) and/or groups $(PO)_y$ (=polyether chain of the formula "—$CHCH_3$—$CH_2$—O—" with y=1 to 10 units with or without an end group cap in particular with a methyl, ethyl, propyl, isopropyl, butyl, isobutyl or benzyl group) independently of one another, and/or can form an oxygen-containing group, which can contain oxygen as a bridging atom to the next alkyl group B—saturated or unsaturated, branched or unbranched—with a number from 1 to 200 carbon atoms, which can optionally contain independently of one another one or more aromatic and/or phenolic groups or can be replaced by the latter, and/or can optionally contain a group selected from amino groups, carbonyl groups, ester groups, ether groups, OH groups and nitro groups on at least one of the carbon atoms and/or between the carbon atoms of in each case at least one of the alkyl groups A and/or B, and/or wherein optionally at least one polymer chain independently of one another, branched or unbranched, with a number of polymer units n from 5 to 1,000,000 monomer base building block units, can be bonded to at least alkyl group R1 independently of one another, wherein the polymer units of at least one cationic group are selected at least in part from polyamides, polycarbonates, polyesters, polyethers, polyamines, polyimines, polyolefins, polysaccharides, polyurethanes, their derivatives, their mixtures and their combinations, wherein optionally independently of one another at least one uncharged monomer and/or at least one corresponding uncharged group can occur as monomer base building block(s), wherein optionally at least one quaternary ammonium group independently of one another can be present with the nitrogen atom in the polymer chain and/or with the nitrogen atom on the polymer chain.

Preferably in the case of cationic polymers—this term, as in other places where the further polymer variants are not listed, can denote a choice from the group consisting of cationic polymers, cationic copolymers, cationic block copolymers and cationic graft copolymers—the at least one alkyl group—saturated or unsaturated, branched or unbranched—can in each case independently of one another contain 3 to 160 carbon atoms, particularly preferably 5 to 120 carbon atoms and most particularly preferably 8 to 90 carbon atoms. It is particularly preferred to choose x from 1 to 7 units; it is most particularly preferred to choose x from 4 or 5 units. It is particularly preferred to choose y from 1 to 4 units; it is most particularly preferred to choose y from 2 or 3 units.

In the process according to the invention the counterions to the amphiphilic compounds and to the cationic polymers are anions preferably selected from the group consisting of ions based on alkyl sulfate, carbonate, carboxylate, halide, nitrate, phosphate, phosphonate, sulfate and/or sulfonate. Suitable counterions are in particular also ions based on halides, such as for example bromide and/or chloride and/or ions based on carboxylate, in particular for example acetate, benzoate, formate, gluconate, heptonate, lactate, propionate, fumarate, maleate, malonate, oxalate, phthalate, succinate, tartrate, terephthalate and/or citrate. Preferably only, or mainly only, monovalent ions occur as counterions in the cationic polymers.

The cationic organic compounds as well as the anionic organic compounds are as a rule polar and water-soluble. When the cationic organic compounds come into contact with the anionic organic compounds originating in particular from the contamination, the ions are neutralised. In this connection the cations, such as in particular the alkali-metal and/or alkaline-earth metal cations, especially ammonium, sodium and/or potassium ions, as well as the anions, such as in particular chloride ions, pass into the aqueous solution and can remain there. On account of the removal, losses due for example to discharge and/or circulation of the bath solution the amount of water constantly has to be replenished, so that in many cases the salts do not become too concentrated.

On the other hand the cationic organic compounds and the anionic organic compounds often form reaction products, via salt formation involving ionic interactions, that are generally very hydrophobic, water-insoluble adducts. Accordingly these reaction products accumulate to a greater extent in the oil-containing contaminants and/or in the oil-containing phase and can be removed together with them. These reaction products interfere since they are very hydrophobic and behave in an interfering manner like oils.

In the process according to the invention it is advantageous in many variants of implementation if cationic organic compounds are added to the bath, especially in the case of discontinuous operation, in an amount in which the stoichiometric ratio of cationic organic compounds to anionic organic compounds is maintained in the range from 0.1:1 to 10:1. In particular this ratio is in the range from 0.5:1 to 5:1, particularly preferably in the range from 0.7:1 to 1.2:1 and most particularly preferably in the range from 0.9:1 to 1:1.

In this connection, especially with discontinuous operation, it is preferred in many variants of implementation to add not more than 1 g/1 of cationic organic compounds, particularly preferably not more than 0.1 g/l and most particularly preferably not more than 0.01 g/l of cationic organic compounds.

If the at least one cationic organic compound is contained in a substoichiometric amount in the bath compared to the unreacted anionic organic compounds present, then the bath is generally only weakly or only very weakly demulsifying. If the at least one cationic organic compound is contained in the bath in excess compared to the unreacted anionic organic compounds present, then the bath is emulsifying and contains scarcely no oil(s) and/or contaminants bound thereto, although the cleaning performance has normally already declined. In a medium range of this ratio of cationic organic compounds to the unreacted anionic organic compounds present in the bath, the demulsifying action of the bath as well as its cleaning performance are normally high and at the same time the content of oil(s) and/or contaminants bound thereto is low or very low. In many variants of implementation it is therefore recommended to operate roughly in the boundary region of the cationic behaviour versus anionic behaviour. A higher cleaning performance is also associated with a better cleaning result.

In many variants of implementation it is advantageous if the cleaning bath additionally contains at least one cleaner framework, in other words at least one builder, and/or a builder is added to the bath. The cleaner framework can help to suppress incipient rusting or corrosion, such as for example flash rusting on steel or white rust formation on zinc surfaces. The cleaner framework can preferably contain at least one builder based on borate(s) such as for example orthoborate(s) and/or tetraborate(s), on silicate(s) such as for example metasilicate(s), orthosilicate(s) and/or polysilicate(s), phosphate(s) such as for example orthophosphate(s), tripolyphosphate(s) and/or pyrophosphate(s), at least one alkaline medium for example based on potassium hydroxide, sodium hydroxide, sodium carbonate, sodium hydrogen carbonate, potassium carbonate and/or potassium hydrogen carbonate, at least one amine for example based on monoalkylamine(s), trialkylamine(s), monoalkanolamine(s) and/or trialkanolamine(s) such as for example monoethanolamine, triethanolamine, methyldiethanolamine and/or at least one complex-forming agent based on carboxylate(s), such as for example gluconate and/or heptonate, the sodium salt of nitriloacetic acid (NTA) and/or based on phosphonate(s) such as for example HEDP. The content of builders is in particular either 0 g/l or in the range from 0.1 to 290 g/l or from 0.2 to 120 g/l, preferably 0 g/l or in the range from 0.5 or from 1 to 100 g/l or from 1.5 to 48 g/l, particularly preferably 0 g/l or in the range from 3 to 25 g/l. In most cases contents of builders in spraying processes are in the range from 1 to 50 g/l, and in dipping processes are in the range from 2 to 100 g/l, normally regardless of whether a continuous or discontinuous process is involved.

In many variants of implementation it is advantageous if the bath contains at least one additive, such as for example a corrosion inhibitor, and/or if at least one additive is optionally also added once more to the bath. Suitable corrosion inhibitors that can be contained in the bath and/or added to the bath are for example those based on alkylamidocarboxylic acid(s), aminocarboxylic acid(s), alkylhexanoic acid(s) and/or boric acid ester(s), in particular their amine salt(s). The content of corrosion inhibitor(s) is normally 0 g/l or in the range from 0.01 to 10 g/l, preferably 0 g/1 or in the range from 0.1 to 3 g/l, particularly preferably 0 g/l or in the range from 0.3 to 1 g/l. Moreover at least one additive, such as for example at least one biocide and/or at least one antifoaming agent, can also be contained in the bath and/or added to the bath, in particular in each case in the range from 0.01 to 0.5 g/l. Furthermore the bath can also contain at least one pickling inhibitor and/or this can be added to the bath. Pickling inhibitors help to reduce or prevent alkaline attack of the cleaning bath, especially with surfaces of aluminium, magnesium, zinc and/or their alloys. Such inhibitors often act extremely selectively depending on the type of metallic surfaces to be protected, which means that in some cases these inhibitors are used in specific mixtures. The content of pickling inhibitors in the bath is in this connection preferably 0 g/l or in the range from 0.01 to 10 g/l, particularly preferably in the range from 0.1 to 8 g/l. Pickling inhibitor(s) that can be used are inter alia borate(s), silicate(s) and/or phosphonate(s).

In the process according to the invention the anionic organic compounds, in particular the anionic surfactants, contained in the bath and normally originating only from contaminants, are preferably rendered less water-soluble by a chemical reaction with at least one cationic organic compound and/or with multivalent cations. Preferably the insoluble compounds formed as a result collect at least in part on the bath surface, in particular in the oil-containing phase, and can then be removed as required from the bath. These surfactants normally originate in particular from the contaminants. The amphoteric surfactants and phosphate esters, which normally likewise originate only from the contaminants, however do not as a rule react chemically in this way and generally remain unaltered and dissolved in the bath solution. All these surfactants are preferably not intentionally added to the bath, since they can interfere especially in the demulsifying and because of the marked tendency to foam formation.

In most cases the overall content of all active substances in the bath is in the range from 1 to 300 g/l or from 1.5 to 150 g/l, preferably in the range from 2 to 50 g/l or 3 to 30 g/1, particularly preferably in the range from 4 to 20 g/l, from 5 to 15 g/l or from 5.5 to 12 g/l. Especially for the cleaning of car body parts, sheet metal and/or parts before phosphating, in spraying processes it can be in particular in the range from 4 to 7 g/l and in dipping processes in particular in the range from 7 to 30 g/l.

In the process according to the invention it is preferred in many variants of implementation, in particular in the case of discontinuous operation of a cleaning process, if not more than 10 g/l of anionic organic compounds accumulate in the bath up to the bath care and maintenance stage, and it is particularly preferred to have not more than 5 g/l or not more than 3.5 g/l, particularly preferably not more than 2 g/l, of anionic organic compounds in the bath.

Especially with discontinuous cleaning processes it may be advantageous to determine the content of oil(s) and/or further contaminants, i.e. in particular oil(s) and/or further non-polar organic compounds, in the bath before adding an appropriate amount of cationic organic compounds and further bath components, such as in particular builders, for the bath care and maintenance. In those units that have been operating for example for more than 3 days and up to 8 weeks and in which the cleaning performance is now only slight or very slight and the bath scarcely or no longer has a demulsifying effect but possibly already has an emulsifying effect, all these contaminants are still largely contained distributed in the bath solution. Only by the addition of cationic organic compounds is there formed in the course of a few hours up to over about 2 days an often approximately 1 to 15 cm thick layer of oil(s) and non-polar organic compounds as an oil-containing phase on the bath surface, which can then be removed in a simple manner, for example mechanically and/or by raising the bath level and allowing the layer to overflow. The amount of cationic organic compounds to be added in this case can be determined either by an Epton titration, chromatographically or simply, accurately and effectively by multiple partial additions of cationic organic compounds, so as to establish by means of the last method the amount of organic compounds above which no significant amounts of oil(s) and non-polar organic compounds are deposited any more and float on the bath surface, i.e. the bath no longer has a demulsifying effect.

With continuously operating cleaning baths on the other hand it is usually sufficient to determine once, when starting up the unit, the amount of cationic organic compounds that need to be regularly added during the metering.

In some variants of implementation it is particularly preferred in a continuous operation mode to adjust the bath so that no or virtually no unreacted cationic organic compounds are contained in the bath. As well as anionic organic compounds taken up by the bath, the unreacted cationic organic compounds contained in the bath will also react with the anionic organic compounds. The terms "anionic organic compounds" and "cationic organic compounds" in the context of the present application denote the corresponding unreacted compounds and not the adducts formed therefrom.

In some units it may be sufficient to operate one cleaning zone (bath) or only some of the various cleaning zones (cleaning baths) in accordance with the invention, especially if in this way the other cleaning zones do not become more heavily loaded with contaminants.

The bath solution can in this connection also be introduced in at least one cleaning zone, for example by spraying and/or spraying and brushing. In the dipping method the at least one substrate can also optionally be electrolytically treated, i.e. by electrolytic cleaning. In particular this, as well as further variants of implementation, are also suitable for strip materials.

The pressure employed in the cleaning processes is in many cases substantially atmospheric pressure if pressures in rolling processes, for example injection flooding processes (pressures of possibly up to about 50 bar), are disregarded, whereas spraying processes are often operated with spraying pressures in the range from 0.1 to 5 bar. The temperatures in the cleaning processes—depending to some extent on the chemical composition—are preferably in the range from 5 to 99° C., particularly preferably in the range from 10 to 95° C., in which connection spraying processes are often operated in the range from 40 to 70° C. and dipping processes are often operated in the range from 40 to 95° C.

The non-ionic surfactants typically have an HLP value in the range from 5 to 12, often in the range from 6 to 12. Surfactants have a demulsifying action preferably at HLB values <10, in particular at HLB values <9.

In the process according to the invention preferably substrates in the form of sheet metal, coils (strips), wires, parts and/or composite structural parts are cleaned. Generally the substrates that are cleaned according to the invention preferably have metallic surfaces of iron, steel, stainless steel, galvanised steel, metallically coated steel, aluminium, magnesium, titanium and/or their alloys.

Surprisingly, despite the experience of many companies in the cleaning field stretching over several decades, a new fundamental principle for cleaning processes has been discovered.

Surprisingly, cleaning processes have been discovered in which even with a very high transfer of contaminants, a demulsifying mode of operation can be re-established without any problem and in a simple way.

Surprisingly, cleaning processes have been discovered that can be operated over the long term with significantly lower contents of oil(s) including further contaminants than was hitherto normal or possible in the prior art with such contaminants, and in which the initially high cleaning performance can be maintained for a long time, whereas with the processes of the prior art the cleaning performance often constantly decreases if membrane filtration methods are not employed: up to now the situation in the prior art is that the cleaning baths currently used to clean metallic surfaces contaminated by inter alia oil(s) have a content of oil(s) including further contaminants with a contamination of at least 0.7 g/l and often in the range from 0.8 to 1.2 g/l for example in automobile plants with bath care and maintenance, and at least 1.5 g/l and often up to ca. 6 g/l of oil(s) including further contaminants for example in automobile plants without bath care and maintenance, and even contents of up to about 20 g/l for example in general industrial plants without bath care and maintenance. On the other hand, with the processes according to the invention it is perfectly possible to employ the cleaning baths with a content of oil(s) including further contaminants in the case of high contamination in the range from at least 0.05 to at least 1 g/l depending on the type of plant and its use, and often of the order of magnitude of about 0.5 g/l for example in automobile plants with bath care and maintenance, or of the order of magnitude of about 8 g/l of oil(s) including further contaminants for example in general industrial plants without bath care and maintenance. With the processes according to the invention it is often possible that these can be used with surfactant contents as low as 0.1 to 0.3 g/l or 0.1 to 0.7 g/l. In the processes according to the invention the content of oil(s) including further contaminants in the cleaning bath can often be maintained in the range from 0.05 to 1 g/l and/or the content of surfactants can often be maintained in the range from 0.05 to 0.5 g/l, whereas with typical cleaning processes of the prior art the content of oil(s) including further contaminants in the cleaning bath is often in the range from 0.7 to 6 g/l and/or the content of surfactants is often in the range from 0.3 to 1.5 g/l.

It is therefore often possible to operate the bath in the processes according to the invention with significantly lower consumption of surfactants and other bath components than was possible hitherto, which can also lead to an extension of the surface life of the bath by a factor of several times or even by several years. In this connection the chemical oxygen demand of the waste water (COD value) from the rinsing zones is often significantly reduced, and as a result the waste water purification can be significantly simplified and made more cost-effective. At the same time the transfer of oils, fats, greases, soaps and further contaminating substances to the pretreatment zone, such as for example to the phosphating zone of an automobile plant, is often also significantly reduced and as a result the quality of the pretreatment process and of the pretreatment layer is significantly improved and made more uniform.

Surprisingly, cleaning processes have been discovered in which in continuous operation the use of complicated and expensive membrane filtration processes for bath care and maintenance involving expensive ultrafiltration units or microfiltration units, which in some cases can involve investment costs of 1 to 2 M€, can be dispensed with. In this connection the use of oil separators can possibly be avoided, which usually involve investment costs of the order of about 10 to 80 T€. By replacing and/or dispensing with a membrane filtration unit a considerable saving in the workforce can be achieved.

Surprisingly, cleaning processes have been discovered that can be used in a comparatively simple manner and whose running costs, depending on the initial conditions, are only slightly higher because of the addition of cationic organic compounds, which were hitherto not necessary, or as a result of lower consumption of chemical substances on account of the improved cleaning performance involve running costs that are roughly the same level or even slightly less than before.

In continuously operating units with oil separators, when using the process according to the invention, often over the long term a lower content of oil(s) including further contaminants is achieved without special measures, compared to processes according to the prior art, in particular since this content can often be reduced roughly by a factor of 2 by the addition of cationic organic compounds.

With discontinuous units, when using the process according to the invention in the case of high contamination the bath is often not replaced (no expensive disposal of the bath), but instead the corresponding amount of cationic organic compounds is added, so that the oil is demulsified and skimmed off as an oil-containing phase. The quality of the oil that is thereby obtained is often so high that in many cases it can even be thermally utilised (combusted), especially if the water content is for example below 20 wt. %, instead of as usual ca. 30 to 50 wt. %. In this way considerable cost savings and simplifications can be made compared to cleaning processes according to the prior art.

The substrates cleaned by the process according to the invention can be used for phosphating, in particular for alkali phosphating, such as for example for iron phosphating, manganese phosphating or zinc phosphating and/or for coating with at least one treatment or pretreatment composition based on silane/siloxane/polysiloxane, titanium/zirconium compounds, iron oxides/cobalt oxide, chromate, oxalate, phosphonate/phosphate and/or organic polymer/copolymer and/or for coating with at least one composition based on a substantially organic polymeric composition, with a welding primer, with a galvanic coating, with an enamel coating, with an anodising, with a CVD coating, with a PVD coating and/or with a temporary corrosion protection coating.

EXAMPLES ACCORDING TO THE INVENTION AND COMPARATIVE EXAMPLES

The invention is described in more detail hereinafter with the aid of selected examples of implementation, without however being restricted to the latter.

In a phosphating plant with a downstream lacquering/paint shop for large format components, the cleaning zones upstream of the phosphating consist of two zones, namely: 1. alkaline dip-degreasing and 2. alkaline spray degreasing. Substantially the same aqueous composition is used in both degreasing baths.

Before changing over to a process according to the invention, in these baths under continuous operation over three to seven weeks contents of oil(s) including further contaminants of more than 3 g/l were established per bath, in particular in the bath used for dip degreasing, in which connection these contents could often be as high as up to 10 g/l. Although cleaner framework and surfactants had been added to the bathe over this period, the baths were not completely replenished. This subsequent addition was necessary on account of the discharge of cleaning components from the baths. With oil contents of the order of magnitude of about 5 g/l of oil(s) including further contaminants, the cleaning performance gradually fell and led to an insufficient degreasing and uneven formation of the subsequently applied phosphate layer. The required high paint quality could therefore no longer be achieved with the necessary degree of certainty. The cleaning baths did not contain any additions of demulsifying surfactants that had been intentionally added and had not possibly originated from the contamination of the baths.

By virtue of the changeover of the operating mode of the cleaning zones to bath compositions to which, after the establishment of a content of oil(s) including further contaminants such as for example fats, greases, further non-polar organic contaminants and/or anionic organic compounds in the bath in the range from 2.5 to 4 g/l of oil(s) including the further contaminants, at least one cationic demulsifying surfactant was added, the respective bath service life could, depending on the operating conditions, be doubled and in some cases even at least quadrupled, before the whole bath was replaced and thus renewed. Because of the addition of the at least one demulsifying surfactant the oil, including the further contaminants, had for the most part accumulated on the surface of the bath as an oil-rich phase including fats, greases and further non-polar organic contaminants. The oil-rich phase contained only 2 to 30 wt. % of aqueous phase including builders and surfactants and also 70 to 98 wt. % in the essential oil(s) and further constituents of the oil-containing phase. The oil-rich phase could then be skimmed off for example after one day. After the oil-rich phase had been skimmed off the bath still contained about 0.5 to 1 g/l of oil(s) including the further contaminants. In this connection, after the separation of the oil-rich phase the at least one anionic and/or non-ionic surfactant principally contained in the bath composition had to be replenished, since these surfactants had to some extent been removed with the oil-rich phase. In this connection the at least one cationic demulsifying surfactant was not replenished immediately, but only when the contents of oil(s) including further contaminants in the bath had readjusted to levels of 2.5 to 4 g/l after several weeks. This surfactant had been specially selected corresponding to the conditions for the demulsifying procedure.

In this unit neither the process parameters of the cleaning zones nor the concentrations of the cleaning compositions that had basically also been used up to this point had to be significantly altered.

In this connection it was also possible to renew the second degreasing bath only after a longer utilisation time (for example after 6 months) than the first degreasing bath (for example after 4 months), which captures the contaminants significantly more strongly than the second degreasing bath.

Thanks to the procedure according to the invention the surfactant concentration of the cleaning baths no longer had to be increased in the case of very high contents of oil(s) and/or further contaminants, and the consumption of chemicals thus fell slightly, but above all because of the renewal of the baths at significantly longer intervals. Since the changeover of the operating procedure of the cleaning baths the phosphating and lacquering/painting no longer exhibited defects that could be attributed to the cleaning. The waste disposal costs of the cleaning baths were dramatically reduced since the waste disposal cycles were significantly extended and highly contaminated cleaning bathe no longer had to be disposed of. Also, the amount of reworking and finishing-off necessary after at least one painting operation, for example involving sanding by hand and in many cases also followed by renewed phosphating and painting, was thereby significantly reduced, which likewise helps to lower high process costs.

The invention claimed is:

1. A process for demulsifying cleaning of metallic surfaces which are contaminated with a contaminant that is an oil, at least one further non-polar organic compound, a fat, a soap, particulate dirt or at least one anionic organic compound, the process comprising:

providing an aqueous, alkaline, surfactant-containing bath;

contacting the metallic surfaces with the aqueous, alkaline, surfactant-containing bath in at least one cleaning zone wherein the bath becomes contaminated with the contaminant;

wherein the aqueous, alkaline, surfactant-containing bath comprises:

at least one demulsifying surfactant comprising at least one nonionic surfactant based on ethoxylated alkyl alcohols having an end group cap and ethoxylated-propoxylated alkyl alcohols having an end group cap, and at least one cationic organic compound;

wherein oil droplets having a radius of curvature are formed in the aqueous, alkaline, surfactant-containing bath and the aqueous, alkaline, surfactant-containing bath is kept in a demulsifying state even during increasing contamination with at least one anionic organic compound;

wherein the content of the at least one demulsifying surfactant in the aqueous, alkaline, surfactant-containing bath ranges from 0.1 to 10 g/l; and wherein the at least one demulsifying surfactant is selected to adjust the radius of curvature of the oil droplets so that the oil in an agitated bath is partially emulsified and does not accumulate as an oil-containing phase on a surface of the agitated bath, and the oil spontaneously deposits and accumulates as an oil-containing phase on a surface of a quiescent bath.

2. The process according to claim 1, wherein the aqueous, alkaline, surfactant-containing bath has a content of the contaminant which is kept at not more than 3 g/l during continuous operation.

3. The process of claim 2, wherein the content of the contaminant in the aqueous, alkaline, surfactant-containing bath is no more than 1 g/l.

4. The process of claim 1, wherein in continuous operation there is not a membrane filtration process or unit.

5. The process of claim 1, wherein the at least one cationic organic compound has an end cap group selected from the group consisting of a methyl, ethyl, propyl, isopropyl, butyl, isobutyl and benzyl group.

6. The process of claim 5, wherein the end group of the at least one cationic organic compound is a benzyl group.

7. The process of claim 2, wherein the aqueous, alkaline, surfactant-containing bath has a content of the at least one demulsifying surfactant kept at or below 0.7 g/l.

8. The process of claim 1, wherein the aqueous, alkaline, surfactant-containing bath has a content of the contaminant which is kept in a range from 0.03 to 2 g/l, and the aqueous, alkaline, surfactant-containing bath has a content of the at least one demulsifying surfacing at or below 0.7 g/l.

9. The process of claim 1, wherein the ethoxylated alkyl alcohols having an end group cap and ethoxylated-propoxylated alkyl alcohols each comprise an alkyl group which is saturate or unsaturated, branched or unbranched, and optionally has an average number of carbon atoms in a range from 6 to 22 carbon atoms an average number of carbon atoms in the range of from 6 to 22 carbon atoms with in each case either a linear or a branched chain construction, wherein the alkyl group optionally contains one or more aromatic and/or phenolic groups, wherein the ethylene oxide chain optionally contains in each case on average 2 to 30 ethylene oxide units, wherein the propylene oxide chain optionally contains in each case on average 1 to 25 propylene oxide units.

10. The process of claim 1, wherein the at least one cationic organic compound is at least one of :

a) an amphiphilic compound which contains at least one of one quaternary ammonium group and of at least one ring group having at least one nitrogen atom as a head group, wherein either the at least one nitrogen atom of the ring group or the ring group has at least one positive charge, and the at least one alkyl group independently of one another, saturated or unsaturated, in each case contains an average number of carbon atoms in the range of from 4 to 22 carbon atoms having in each case either a linear or a branched chain construction, wherein the alkyl group optionally independently of one another is saturated or unsaturated, branched or unbranched and in each case optionally contains one or more aromatic groups or is replaced by those, and wherein optionally at least one alkyl group optionally contains a different number of carbon atoms to at least one other alkyl group, and b) a cationic polymer which contains at least one quaternary ammonium group and at least four units of a monomer base unit.

11. The process of claim 1, wherein the bath further comprises at least one demulsifying surfactant selected from the group consisting of nonionic surfactants based on block copolymers which contain at least one polyethylene oxide block and at least one polypropylene oxide block, the polyethylene oxide block of which comprising an average number of 2 to 100 ethylene oxide units and the polypropylene oxide block of which comprising an average number of 2 to 100 propylene oxide units, wherein optionally independently of one another in each case one or more polyethylene oxide blocks or polypropylene oxide blocks are contained in the block copolymer.

12. The process of claim 1, wherein the bath further comprises at least one demulsifying surfactant selected from the group consisting of nonionic surfactants based on surfactants of ethoxylated or ethoxylated-propoxylated alkanoic acids, the alkyl group of which being saturated, unsaturated or cyclic, branched or unbranched and contains an average number of carbon atoms in the range of from 6 to 22 having in each case a linear or branched chain construction and the polyethylene oxide chain of which contains an average number of ethylene oxide units in the range of from 2 to 30 and/or the average number of propylene oxide units of which is in the range of from 1 to 25.

13. The process of claim 1, wherein the bath further contains at least one demulsifying surfactant chosen from the group consisting of nonionic surfactants based on ethoxylated alkylamines, the alkyl group of which, saturated or unsaturated, contains an average number of carbon atoms in the range of from 6 to 22, having in each case a linear or branched chain construction, and the polyethylene oxide chain of which contains an average number of ethylene oxide units in the range of from 3 to 30 and/or the average number of propylene oxide units of which is in the range of from 1 to 25.

* * * * *